United States Patent [19]

Serter

[11] Patent Number: 4,875,425

[45] Date of Patent: Oct. 24, 1989

[54] HULL FORMS

[76] Inventor: Erbil H. Serter, 34, Chemin du Pommier, CH-1218 Grand-Saconnex, Switzerland

[21] Appl. No.: 125,176

[22] Filed: Nov. 25, 1987

[30] Foreign Application Priority Data

Nov. 26, 1986 [EP] European Pat. Off. ..... 86309223.5

[51] Int. Cl.[4] ..... B63H 5/08

[52] U.S. Cl. ..... 114/56

[58] Field of Search ..... 114/56, 57, 271, 288, 114/289, 290, 291

[56] References Cited

U.S. PATENT DOCUMENTS 1,599,312 9/1926 Chimang ..... 114/57
3,040,687 6/1962 Huet ..... 114/56

FOREIGN PATENT DOCUMENTS 0178294 8/1986 Japan .
13506 6/1911 United Kingdom ..... 114/57

*Primary Examiner*—Joseph F. Peters, Jr.

*Assistant Examiner*—Edwin L. Swinehart

*Attorney, Agent, or Firm*—Arnold S. Weintraub; Gerald R. Black

[57] ABSTRACT

A hull form for a vessel which hull form is deep-Vee based and is constructed and arranged for use in a displacement mode. The hull includes a bow section which incorporates a plurality of lateral grooves or, alternatively, a single lateral formation and which extends below the base or datum line of the hull in a streamlined teardrop configuration. Preferably, the hull has deep-Vee deadrise angles (1) whose magnitudes in the region of the transom of the hull are not less than 20°. The surfaces extending between the keel and the water line length are non-planar and have developable convex and concave geometry, all buttock lines of the hull having a negative inclination of between substantially ½° and substantially 4°. The invention enables the known advantages of deep-Vee based hull forms to be used in displacement mode vessels having relatively large displacements where, heretofore, "round-bilge" hull forms very greatly predominated.

9 Claims, 3 Drawing Sheets

HULL FORMS

BACKGROUND OF THE INVENTION

1. Field of the Invention:

This invention relates to hull forms and to vessels provided with such hull forms.

2. Prior Art:

Hull forms of the so-called "deep-Vee" kind are well known and the term in question is descriptive, being derived from the basis shape of such a hull. The deep-Vee hull form has many advantages as compared with the alternative 'round-bilge' hull form and these advantages are particularly marked in a vessel of deep-Vee hull form that is constructed and arranged for use in a planing mode. Although some vessels of relatively small displacement are known having deep-Vee based hulls constructed and arranged for use in a displacement, rather than planing, conventional deep-Vee based hull forms do not really lend themselves to advantageous use in larger displacement mode vessels. Larger vessels that are for use in displacement mode are principally of the round-bilge form. It is to be appreciated that it would be advantageous to have a deep-Vee based hull form which can be employed in a displacement mode vessel of substantially any displacement volume so that the known advantages of deep-Vee based hull forms can be enjoyed by substantially any vessels, and particularly by vessels having a displacement volume of substantially 15 tonnes or more where, as already mentioned, the round-bilge form very greatly predominates.

Among the advantages of having a deep-Vee based hull form in a vessel constructed and arranged for use in a displacement mode are good seakeeping performance in both calm and rough sea conditions, low roll, pitch and yaw characteristics and, particularly, a low incidence of slamming. The steerability, acceleration and deceleration of a displacement mode vessel provided with a deep-Vee based hull form are all excellent.

SUMMARY OF THE INVENTION

According to the invention, there is provided a deep-Vee based hull form constructed and arranged for use in a displacement mode, wherein a plurality of lateral grooves or a laterally hollowed formation at each side, or a combination of both, is provided in the bow section. The bow section is extended below the base or datum line of the hull in a streamlined teardrop configuration.

For a better understanding of the invention, and to show how the same may be carried into effect, reference will now be made, by way of example, to the accompanying drawings, in which:

DESCRIPTION OF THE PREFERRED EMBODIMENTS

Referring to the accompanying drawings, it will immediately be apparent that the hull form of the hard chine vessel which is illustrated is basically of deep-Vee configuration. The illustrated hull has a beam of 13.4 meters and it can be seen in FIG. 1 of the drawings that the deadrise angle 1 of the hull form has a magnitude of 25°. This inclination is by no means mandatory but the deadrise angle 1 should not have a magnitude of less than 20°. Depending upon the speed-to-length ratio requirements of the particular vessel in which the hull form is to be employed, the deep-Vee deadrise angle may be varied from aft to midships. In particular, the hull of a vessel having relatively low speed-to-length ratio requirements may have the deadrise angle 1 progressively increased by substantially another 2° to substantially another 9° compared with the angle at the transom. The increase in the deadrise angle commences at a location spaced forwardly from the transom by 0.3 times the magnitude of the length of the water line.

Alternatively, the keel inclination may be increased by substantially 1° to 5° with a constant cross-sectional profile, commencing at between 0.10 to 0.30 times the length water line, forwardly from the transom.

Figure 1:
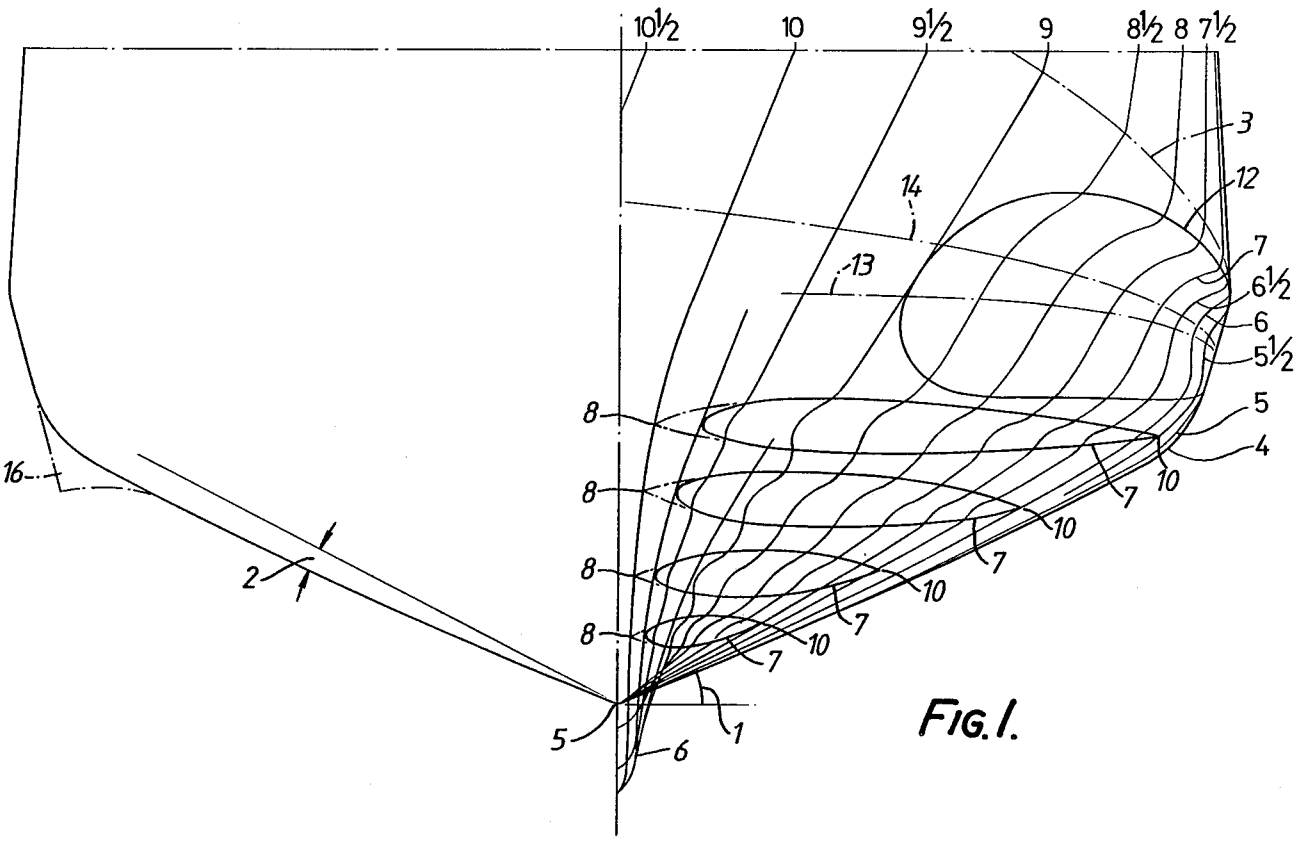
FIG. 1 is a diagrammatic longitudinal view of a deep-Vee based hull form constructed in accordance with the invention.

The transom itself may have rounded corners. The angular increase 2 is shown in FIG. 1.

The deep-Vee longitudinal center of buoyancy should be as close as possible to midships and within up to 16% of the length of the water line magnitude, either forwardly or aft from there, depending upon the speed and displacement requirements of the particular vessel.

The vessel which is illustrated has a hard chine hull exhibiting a relatively sharp-angled upper chine 3 and a rounded lower chine 4. The upper chine 3 has a relatively sharp angular configuration throughout substantially all of its length and it is incorporated into the corresponding side wall of the hull. The lower chine 4 has a rounded configuration between a location aft of the bow spray rail and a location just in advance of midships.

The hull has a base line or datum line 5. The bow section of the hull form extends downwardly below the base line or datum line 5 to produce a streamlined teardrop configuration 6, disregarding any equipment that may eventually be carried thereby.

In accordance with a feature of the invention, the bow section of the hull incorporates a plurality of grooves, such as, for example, four grooves that extend generally parallel to one another at vertically spaced apart levels which are between the base line or datum line 5 and the lower rounded chine 4.

Figure 3:
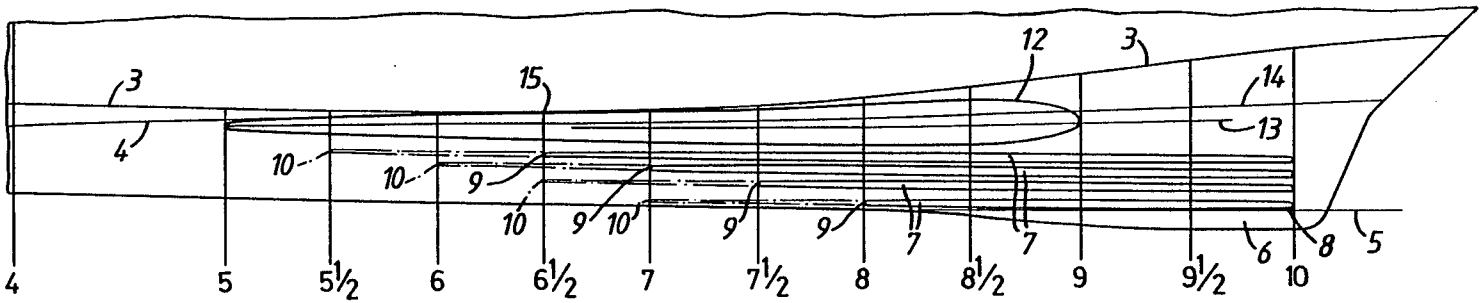
FIG. 3 is a side elevation substantially corresponding to FIG. 1.

As shown in FIG. 3, the grooves 7 all commence at forward locations 8 which are a short distance aft from the extreme forward end of the bow section of the hull. The length of each groove 7 may vary depending upon the requirements of the particular vessel upon which a hull in accordance with the invention is to be based. In FIG. 3, a first set of rearward locations 9 is indicated for the grooves 7 together with a second set of rearward locations 10 each of which latter locations 10 is further aft of the hull than is the corresponding alternative rear location 9. Similarly, the cross-sectional dimensions of each groove 7 will vary in accordance with the same factors but will be in substantially the same proportion to the measurements of the whole vessel as is illustrated in FIGS. 1 and 3 hereof.

In the embodiment shown in the drawing a plurality of stations are marked along the base or datum line 5. The forward locations 8 at the leading ends of all four of the grooves 7 are each at station 10. The rearmost end or aft end of the lowermost groove 7 can be anywhere between station 7 and station 8, while the rearmost or aft end of the uppermost groove 7 can be anywhere between statio 5½ and station 6½. The optimum positions for the rear locations 9 and 10 must be calculated for each particular complete vessel design. The illustrated rear locations 9 and 10 merely show the foremost and rearmost possible positions for the aft ends of the grooves 7 in one particular vessel.

Figure 2:
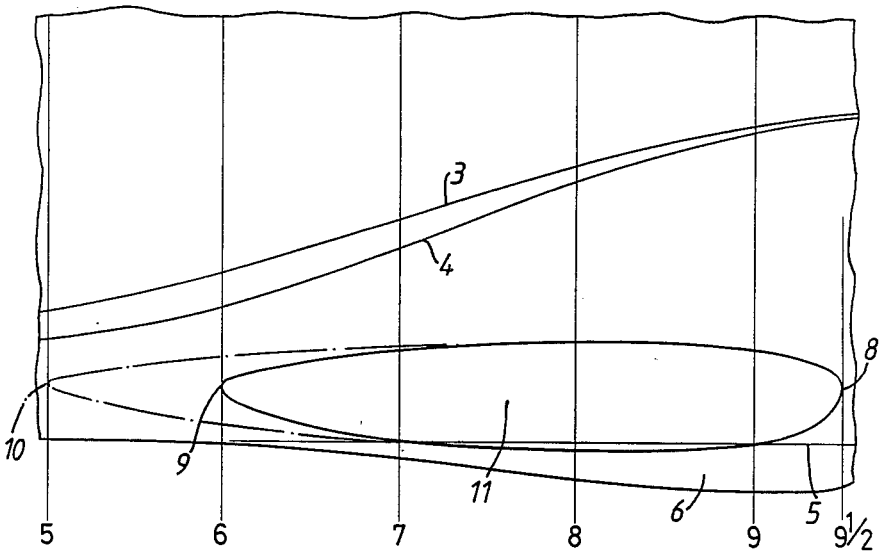
FIG. 2 is a diagrammatic side view showing an alternate embodiment hereof.

It should further be emphasized that there can be more or less than four grooves 7 and that, in particular, a single laterally hollowed formation 11 may be substituted for the grooves 7 at each side of the hull form, as shown in FIG. 2. The hollowed formation 11 may extend, in a vessel having hull dimensions similar to those of the vessel shown in the drawings, rearwardly from a forward location 8 that is at station 9½ to anywhere, depending upon the requirements of the particular vessel, between a rear location 9 at station 6 and an alternative rear location 10 at station 5. The margins of the two laterally hollowed formations 11 at each side of the hull are margins which merge into the corresponding surfaces of the hull in a rounded, rather than angular, manner. If desired, a construction employing a combination of the grooves 7 and the two hollowed formations 11 may be employed.

Figure 4:
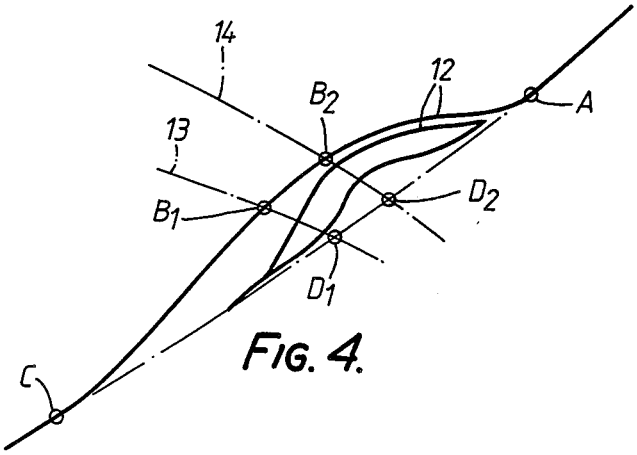
FIG. 4 is a diagrammatic sectional view, to an enlarged scale, illustrating the geometry of a recessed formation of a hull.

Referring, now, to FIGS. 3 and 4, each side surface of the hull is preferably formed, below the upper chine 3, with a recessed formation 12 whose foremost extremity is at station 9 and whose rearmost end is at station 5. In FIG. 4 there is diagrammatically illustrated the cross-sectional shape of the recessed formation 12, while FIGS. 3 and 4 show locations A, C, $D_1$ and $D_2$. By comparing FIGS. 3 and 4 it is seen that in the embodiment which is being described, the cross-sectional shape of the recessed formation 12 is shown at station 8 looking towards the stern so that the developing shape of the recess 12 can be seen.

Locations $B_1$ and $B_2$ are shown in the hull in FIG. 4. A line 14 passing through both locations $B_2$ and $D_2$ corresponds to the so-called length water line 1. A line 13 which joins the locations $B_1$ and $D_1$ corresponds to the so-called length water line 2.

It is to be understood that the drawings show the shape of the recessed formation 12 at only one side of the hull. Of course, the hull form is symmetrical about a vertical, longitudinally extending, central plane so that any specialized shaping of the hull form that is to be found at one lateral side thereof, also, occurs symmetrically at the opposite laterial side thereof.

The opposite symmetrically inclined surfaces of the hull between the keel and the water line length are entirely non-planar and have developable convex and concave geometry throughout. The maximum depth of any concavity is not greater than substantially 10% of the hull girth.

Another feature of the present invention is that all of the buttock line of the hull are inclined to a horizontal plane in a "bow down" configuration. The magnitude of the inclination is variable in, consequently, negative degrees between substantially one half of a negative degree and substantially 4 negative degrees. The hull advantageously has a displacement to water line length ratio between 40 and 240 and a water line length to water line beam ratio between 4 and 12. Both of these ratios are variable depending upon the required speed of travel and the displacement of any vessel based upon a hull form in accordance with the invention.

As shown in FIG. 3 the two chines 3 and 4 merge with one another towards the bow at a location 15 which is substantially 0.3 times the magnitude of the length water level from fore perpendicular aft. The merged chines 3 and 4 continue forwardly to form a bow chine 3. This bow chine and the stern post are secured to one another at a distance from the base line or datum line 5 which is equal to substantially twice the midships draft of the hull. When a hull of high speed construction is required, its upper chine 3, preferably, incorporates a spray rail. Although not shown in the drawings, the spray rail has hollow sections extending inwardly throughout substantially the whole of the length water line. Each bow chine, preferably, has relatively large spray rails and is formed with an interior concave section. Relatively small upwardly opening slots may be provided with this construction.

A skeg 16 is advantageously fitted at the bottom of the transom and, when so fitted, preferably has a depth at the transom which is not greater in magnitude than the depth by which the teardrop configuration 6 of the bow section projects beneath the base line or datum line 5. The skeg 16 has a length whose magnitude is substantially 0.2 times the magnitude of the length water line. The skeg is streamlined and progressively reduces to a zero projection at its leading end. Shaped skegs in the form of streamlined plates may advantageously also be provided at both the port and starboard sides of the hull in the form of bilge keels extending forwardly from the transom.

In a vessel having a displacement mode, deep-Vee based hull form and a length in excess of about 20 meters, a relatively low added resistance is experienced in conditions above sea state 4 (8 foot waves) and the incidence of slamming is very low. Such slamming often being entirely absent. In particular, there is usually no slamming whatsoever when the speed-to-length ratio of the vessel has a value in excess of unity. The lowered resistance to forward progress that is encountered by a vessel having a hull form in accordance with the present invention is particularly significant in sea conditions where the waves have a height of 6 feet or more. The directional stability or steerability in sea conditions where the wave height is in excess of about 6 feet is particularly well maintained in a vessel whose speed-to-length ratio is in excess of unity. The resistance to forward progress of a vessel having a hull form in accordance with the invention is relatively low at a slow forward speed and, in conditions above sea state 4 (8 foot waves), relatively low heave, vertical velocity and vertical acceleration are experienced together with low roll, pitch and yaw.

I claim:

1. A deep-Vee based hull form constructed and arranged for use in a displacement mode, the hull having side walls, a bow, and a bilge, the hull form having a datum line disposed proximate to the bilge of the hull, the bow having a plurality of horizontal cross-sections, the horizontal cross-sectons being generally parallel to the datum line, the hull form comprising at least one lateral groove at each side of the bow section, the hull having a deadrise angle of at least 20 degrees, said bow section being extended below the datum line of the hull in a streamlined teardrop configuration, each horizontal cross-section of the bow disposed downwardly from the datum line being progressively smaller.

2. The hull form of claim 1, further comprising a recessed formation disposed on each side wall of the hull, each recessed formation being extended lengthwise on each side of the hull from a location that is to the rear of the bow.

3. The hull form of claim 1, further comprising a hollow formation disposed on each side wall of the hull, each hollow formation extending laterally along each side wall from a location that is to the rear of the bow, and each hollow formation merging into the side wall in a rounded manner.

4. A large displacement vessel having a deep-Vee based hull form constructed and arranged for use in a displacement mode, the hull having side walls, a bow, and a bilge, the hull form having a datum line disposed proximate to the bilge of the hull, the bow having a plurality of horizontal cross-sections, the horizontal cross-sections being generally parallel to the datum line, the vessel comprising a lateral groove on each side of the hull form the hull having a deadrise angle of at least 20 degrees, a bow section of the hull form extending below the datum line of the hull in a streamlined teardrop configuration, each horizontal cross-section of the bow section disposed downwardly from the datum line being progressively smaller.

5. The vessel of claim 4, wherein the hull form includes a multiplicity of lateral grooves on each side of the hull, the grooves being spaced apart in a vertical direction along each side wall, a forward location of each groove being in substantial alignment along the side wall, and each groove disposed downwardly along the hull form being progressively shorter.

6. The vessel of claim 4, further comprising a recessed formation disposed on each side wall of the hull, each recessed formation being extended lengthwise on each side of the hull from a location that is to the rear of the bow.

7. The vessel of claim 4, further comprising a hollow formation disposed on each side wall of the hull, each hollow formation extending laterally along each side wall from a location that is to the rear of the bow, and each hollow formation merging into the side wall in a rounded manner.

8. The vessel of claim 4, and having a displacement in excess of 15 tons.

9. A deep-Vee based hull form constructed and arranged for use in a displacement mode, the hull having a first side wall and a second side wall, a bow, and a bilge, the hull form having a datum line disposed proximate to the bilge of the hull, the bow having a plurality of horizontal cross-sections, the horizontal cross-sections being generally parallel to the datum line, the hull form comprising a multiplicity of lateral grooves on each side of the hull, the grooves being spaced apart in a vertical direction along the first and the second side wall, a forward location of each groove being in substantial alignment along the first and the second side wall, each groove disposed downwardly along the hull form being progressively shorter, the bow extending below the datum line of the hull in a streamlined teardrop configuration, each horizontal cross-section of the bow disposed downwardly from the datum line being progressively smaller.

* * * * *